US007425924B2

(12) United States Patent
Chung et al.

(10) Patent No.: US 7,425,924 B2
(45) Date of Patent: Sep. 16, 2008

(54) MULTI-FREQUENCY ANTENNA WITH DUAL LOOPS

(75) Inventors: Ming-Hsun Chung, Taipei (TW); Tsung-Wen Chiu, Taipei (TW); Fu-Ren Hsiao, Taipei (TW); Yu-Ching Lin, Taipei (TW); Chun-Ching Lan, Taipei (TW)

(73) Assignee: Advanced Connectek Inc., Taipei (TW)

( * ) Notice: Subject to any disclaimer, the term of this patent is extended or adjusted under 35 U.S.C. 154(b) by 0 days.

(21) Appl. No.: 11/696,190

(22) Filed: Apr. 4, 2007

(65) Prior Publication Data

US 2007/0285321 A1 Dec. 13, 2007

(30) Foreign Application Priority Data

Jun. 9, 2006 (TW) ..... 95120597 A

(51) Int. Cl.
*H01Q 1/24* (2006.01)

(52) U.S. Cl. ..... 343/702

(58) Field of Classification Search ..... 343/700 MS, 343/702, 846, 848
See application file for complete search history.

(56) References Cited

U.S. PATENT DOCUMENTS 6,222,494 B1 * 4/2001 Erkocevic ..... 343/790
6,480,162 B2 * 11/2002 Sabet et al. ..... 343/767
6,836,252 B2 * 12/2004 Tai et al. ..... 343/702
7,026,999 B2 * 4/2006 Umehara et al. ..... 343/702
7,034,754 B2 * 4/2006 Hung et al. ..... 343/700 MS
7,136,025 B2 * 11/2006 Lin et al. ..... 343/770
7,170,450 B2 * 1/2007 Chang et al. ..... 343/700 MS
7,212,161 B2 * 5/2007 Chen et al. ..... 343/700 MS
2004/0222936 A1 * 11/2004 Hung et al. ..... 343/795
2007/0120753 A1 * 5/2007 Hung et al. ..... 343/702
2007/0247372 A1 * 10/2007 Huang ..... 343/700 MS

* cited by examiner

*Primary Examiner*—Huedung Mancuso
(74) *Attorney, Agent, or Firm*—Jianq Chyun IP Office

(57) ABSTRACT

A multi-frequency antenna with dual loops is provided. The antenna includes a T-shaped radiator having a first arm and a second arm of unequal lengths as a main body, and two grounded L-shaped radiators, so as to form dual loops. Thus, the antenna can operate in a high-frequency operation mode and a low-frequency operation mode. With the dual loops, the antenna obtains enough bandwidths at high frequency, and also meets the requirements of low frequency. More specific, the antenna meets the requirements of high-frequency systems, such as DCS/PCS/UMTS and those of low-frequency systems, such as AMPS/GSM.

13 Claims, 5 Drawing Sheets

MULTI-FREQUENCY ANTENNA WITH DUAL LOOPS

CROSS-REFERENCE TO RELATED APPLICATION

This application claims the priority benefit of Taiwan application serial no. 95120597, filed Jun. 9, 2006. All disclosure of the Taiwan application is incorporated herein by reference.

BACKGROUND OF THE INVENTION

1. Field of the Invention

The present invention relates to a multi-frequency antenna with dual loops. More particularly, the present invention relates to a multi-frequency antenna which can operate in two different frequency bands with the dual loops thereof.

2. Description of Related Art

The personal mobile communications technology has already proven its huge potential and business opportunity in the wireless communications industry. In the course of advancement, various systems adopting different technologies and frequency bands have been developed and used in different areas and markets. However, this also brings troubles and inconvenience to system suppliers and consumers due to different systems, such as GSM900, DCS1800, and PCS1900, adopting different frequencies.

In order to bring convenience to the users, people in this field have exerted a lot of efforts in the development of a multi-frequency mobile phone. However, the problem to be solved firstly is the antenna which is considered to be the start as well as the end of the wireless communications, and the following requirements must be satisfied:

1. Frequency and bandwidth; and
2. Radiation pattern and polarization.

Moreover, it is the tend for the design of electronic products including the mobile phone to become lighter, thinner, shorter, and smaller, even the design of the antenna of mobile phone is influenced. Thus, the conventional planar inverted-F antenna (PIFA) cannot meet the requirements of larger bandwidth gradually. U.S. Pat. No. 6,943,730 discloses one of the multi-frequency and low-profile, capacitively loaded magnetic dipole (CLMD) antennas. Referring to FIG. 1, the antenna 10 uses two top plates 12, 14 and a bottom plate 16 connected with a feed line to create the inductive part 20, 22, so as to be compatible with the low-frequency GSM channel and the high-frequency PCS channel. As disclosed in the specification, in order to broaden the bandwidth, more than two top plates must be used together to increase the multi-frequency effect. Therefore, the structure is not suitable for a compact device with a limited space for accommodating the antenna.

Another antenna that realizes the multi-frequency operation is shown in FIG. 2. The antenna includes a first radiation portion A, a second radiation portion B, and a ground portion C. The first radiation portion A and the second radiation portion B respectively extend from the two opposite portions of the same end of the ground portion C. The first radiation portion A includes a first conductive tab A1 parallel to the ground portion C and a first connection portion A2 connecting the first conductive tab A1 and the ground portion C. The second radiation portion B includes a second conductive tab B1 parallel to the ground portion C and a second connection portion B2 connecting the second conductive tab B1 and the second connection portion B2. The first conductive tab A1 and the second conductive tab B1 respectively extend from the first connection portion A2 and the second connection portion B2 in the same direction.

The above antenna makes the multi-frequency operation possible, but still has the following disadvantages. The first connection portion A2 is excessively close to the second connection portion B2, which does not meet the requirement of the high-frequency bandwidth. Meanwhile, the first connection portion A2 is excessively close to the second connection portion B2, and the first conductive tab A1 and the second conductive tab B1 respectively extend from the first connection portion A2 and the second connection portion in the same direction, so the fabrication is difficult when bending the first radiation portion A and the second radiation portion B and when welding the feed line onto the first conductive tab.

The present invention provides a solution to the above problems, which can significantly broaden the multi-frequency high-frequency bandwidth and simplify the fabricating process of the antenna.

SUMMARY OF THE INVENTION

The present invention is directed to a multi-frequency antenna with dual loops, which increases the capacity of the antenna through the coupling effect in the loops, so that the multi-frequency antenna has the characteristics of miniaturization and broad band at high frequency, thus achieving the bandwidth of 1710-2170 MHz and meeting the requirements of the bandwidths used in the systems such as DCS, PCS, and UMTS.

The present invention is also directed to a multi-frequency antenna with dual loops, which increases the capacity of the antenna through the coupling effect in the loops, so that the multi-frequency antenna has the characteristics of miniaturization and broad band at low frequency, thus achieving the bandwidth of 824-960 MHz and meeting the requirements of the bandwidths used in the systems such as AMPS and GSM.

The present invention is still directed to a multi-frequency antenna with dual loops, which employs a T-shaped radiator having a first arm and a second arm of unequal lengths and two grounded L-shaped radiators to form two different loops, thereby achieving the effects of adjusting frequency and matching impedance by adding coupling capacitance in the loops.

As embodied and broadly described herein, the present invention uses the following technical features to realize the above objectives. The main architecture of the present invention includes a T-shaped radiator, a first L-shaped radiator, a second L-shaped radiator, a ground plane, and a feeder cable serving as a feed line to form an antenna with dual loops. The T-shaped radiator has a first portion and a second portion, wherein the second portion includes a first arm and a second arm, and both the first arm and the second arm are perpendicularly connected to the first portion and extending parallel to the ground plane in opposite directions. The first portion is perpendicularly connected to the ground plane. The first L-shaped radiator has a shorter portion perpendicularly connected to the ground plane with one end thereof and a longer portion perpendicularly connected to the other end of the shorter portion of the first L-shaped radiator. The second L-shaped radiator has a shorter portion perpendicularly connected to the ground plane with one end thereof and a longer portion perpendicularly connected to the other end of the shorter portion of the second L-shaped radiator. The feeder cable has a positive signal wire electrically connected with the first portion of the T-shaped radiator and a negative signal wire electrically connected with the ground plane. The length of the first arm is different from that of the second arm, the longer portion of the first L-shaped radiator and the second arm of the T-shaped radiator extend in the same direction and the longer portion of the first L-shaped radiator is spaced apart from the first arm of the T-shaped radiator, and the longer portion of the second L-shaped radiator and the first arm of the T-shaped radiator extend in the same direction and the longer portion of the second L-shaped radiator is spaced apart from the second arm of the T-shaped radiator.

According to the present invention, the T-shaped radiator, the first and the second grounded L-shaped radiators are employed to form two independent loops, which allow the antenna to operate in various frequency bands. Therefore, not only the bandwidth is broadened, but also a significant frequency downconversion is achieved. Meanwhile, the multi-frequency function can be achieved by using the structure of a T-shaped radiator and two L-shaped radiator only, thus greatly reducing the difficulty and cost of fabricating the product.

In order to make the content of the present invention apparent, the detailed description is given below.

In order to make the aforementioned and other objectives, features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
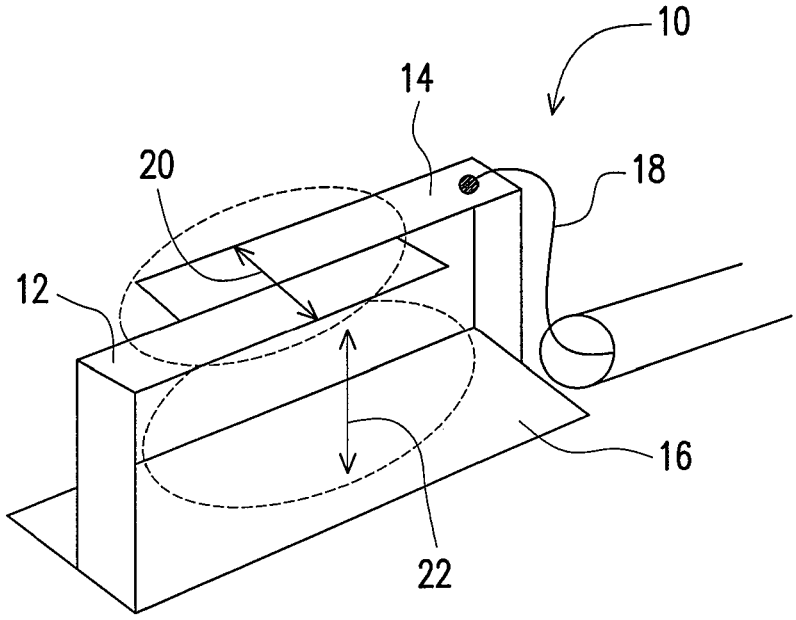
FIG. 1 (PRIOR ART)
FIG. 1 is a perspective view of a conventional multi-frequency antenna.
Figure 2:
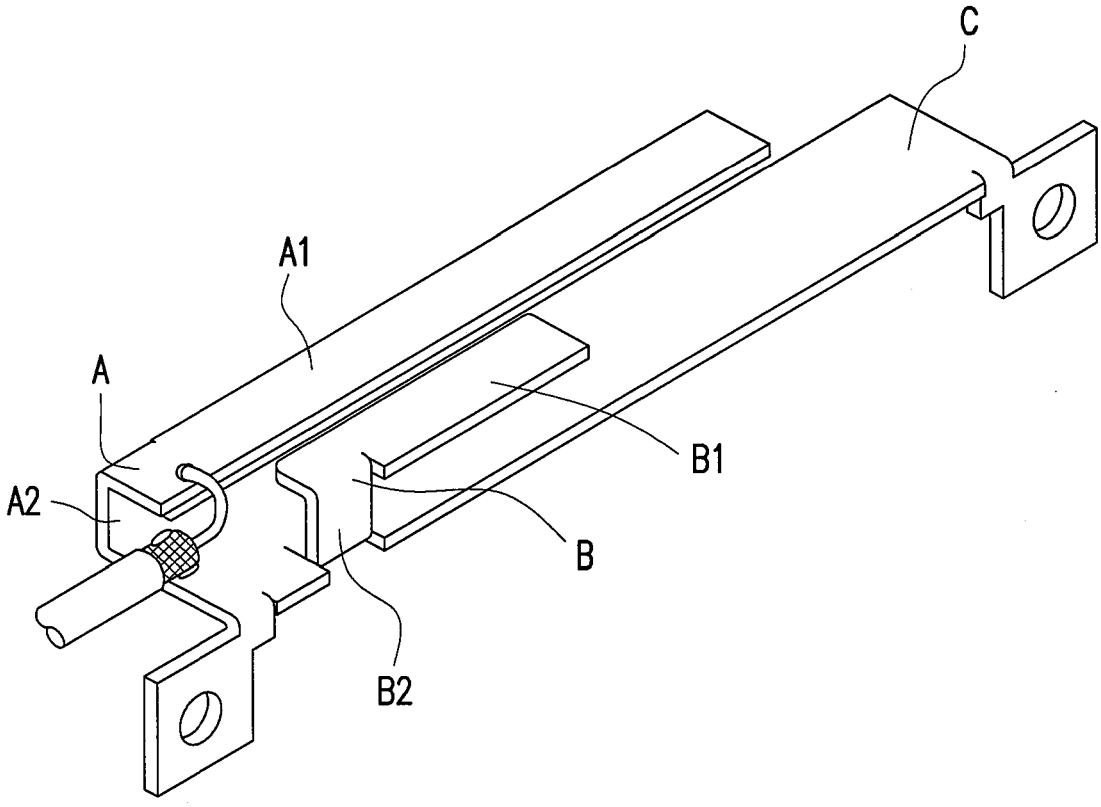
FIG. 2 (PRIOR ART)
FIG. 2 is a perspective view of another conventional multi-frequency antenna.
Figure 3:
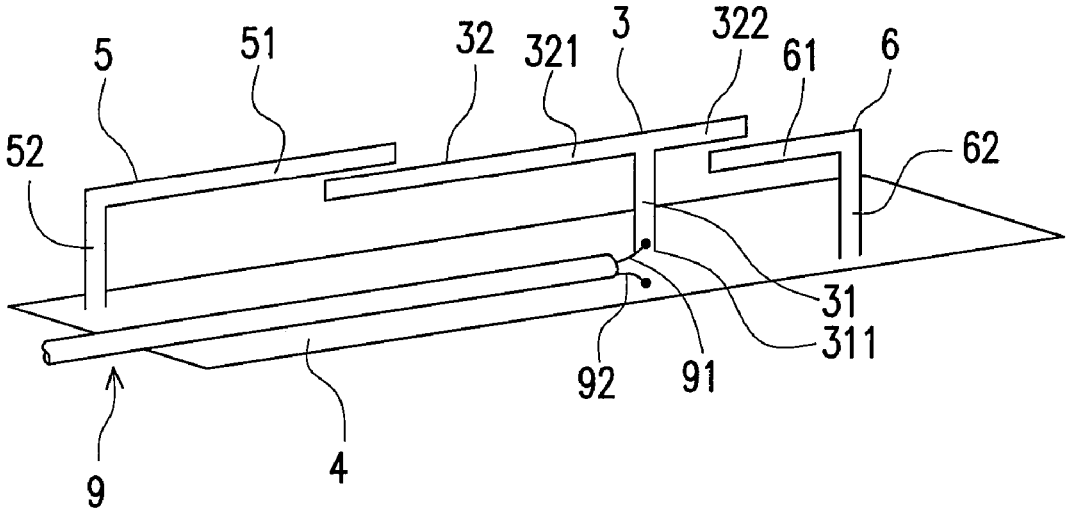
FIG. 3 is a perspective view of an antenna according to a first embodiment of the present invention.

Referring to FIG. 3, the multi-frequency antenna in the first embodiment of the present invention includes a T-shaped radiator 3, a first L-shaped radiator 5 and a second L-shaped radiator 6, a ground plane 4, and a feeder cable 9. In this embodiment, a first arm 321 and a second arm 322 of the T-shaped radiator 3 are suspended above the ground plane 4, but the bottom 311 of a first portion 31 of the T-shaped radiator 3 is connected with a positive signal wire 91 of the feeder cable 9 for transmitting an electrical signal to the T-shaped radiator 3, and the negative signal wire 92 of the feeder cable 9 is electrically connected with the ground plane 4.

The two L-shaped radiators includes a first L-shaped radiator 5 and a second L-shaped radiator 6 opposite to the first L-shaped radiator 5. The longer portion 51 of the first L-shaped radiator 5 and the longer portion 61 of the second L-shaped radiator 6 point to each other and are spaced away from and parallel to the second portion 32 of the T-shaped radiator 3. In this embodiment, the longer portion 51 of the first L-shaped radiator 5 is parallel to the first arm 321 of the T-shaped radiator 3, and the longer portion 61 of the second L-shaped radiator 6 is parallel to the second arm 322 of the T-shaped radiator 3. The shorter portions 52, 62 are respectively connected with the ground plane 4, thus being grounded. The longer portions 51 of the first L-shaped radiator 5 and the longer portions 61 of the second L-shaped radiator 6 are horizontally parallel to the second portion 32 of the T-shaped radiator 3, but the present invention is not limited to this. In another embodiment, the longer portions 51 of the first L-shaped radiator 5 and the longer portions 61 of the second L-shaped radiator 6 are parallel to the second portion 32 of the T-shaped radiator 3 longitudinally.

When an electrical signal is input by the positive signal wire 91 of the feeder cable 9 from the bottom 311 of the first portion 31 of the T-shaped radiator 3, a low-frequency loop antenna is formed by the capacitive coupling effect between the first arm 321 of the T-shaped radiator 3 and the longer portion 51 of the first L-shaped radiator 5. Meanwhile, a high-frequency loop antenna is formed by the capacitive coupling effect between the second arm 322 of the T-shaped radiator 3 and the longer portion 61 of the second L-shaped radiator 6, so as to form an operation mode of two frequencies. Please refer to the data in the following table and FIG. 4.

| Frequency | Directivity (dBi) | Radiation Efficiency (%) | Maximum Gain(dBi) |
|---|---|---|---|
| 824 | 3.82 | 25.31 | −2.15 |
| 836 | 3.38 | 25.64 | −2.53 |
| 849 | 4.41 | 25.06 | −1.60 |
| 869 | 4.96 | 40.55 | 1.04 |
| 880 | 4.63 | 41.25 | 0.78 |
| 894 | 4.39 | 44.83 | 0.91 |
| 900 | 4.51 | 47.12 | 1.25 |
| 915 | 4.52 | 46.14 | 1.16 |
| 925 | 3.81 | 47.19 | 0.55 |
| 940 | 4.18 | 39.39 | 0.13 |
| 960 | 4.35 | 35.46 | −0.16 |
| 1710 | 5.71 | 74.09 | 4.40 |
| 1750 | 4.22 | 68.59 | 2.59 |
| 1785 | 5.51 | 70.22 | 3.98 |
| 1805 | 5.43 | 66.15 | 3.63 |
| 1840 | 4.29 | 68.48 | 2.65 |
| 1850 | 4.06 | 70.26 | 2.53 |
| 1880 | 3.67 | 71.21 | 2.19 |
| 1910 | 4.73 | 67.83 | 3.04 |
| 1920 | 4.88 | 69.27 | 3.28 |
| 1930 | 4.57 | 64.65 | 2.67 |
| 1950 | 4.75 | 66.04 | 2.95 |
| 1960 | 4.51 | 65.15 | 2.65 |
| 1980 | 3.83 | 58.51 | 1.51 |
| 1990 | 3.43 | 60.46 | 1.24 |
| 2110 | 5.46 | 44.28 | 1.92 |
| 2140 | 2.97 | 48.88 | −0.14 |
| 2170 | 3.64 | 50.08 | 0.63 |

Maximum Gain=Directivity×Radiation Efficiency

Figure 4:
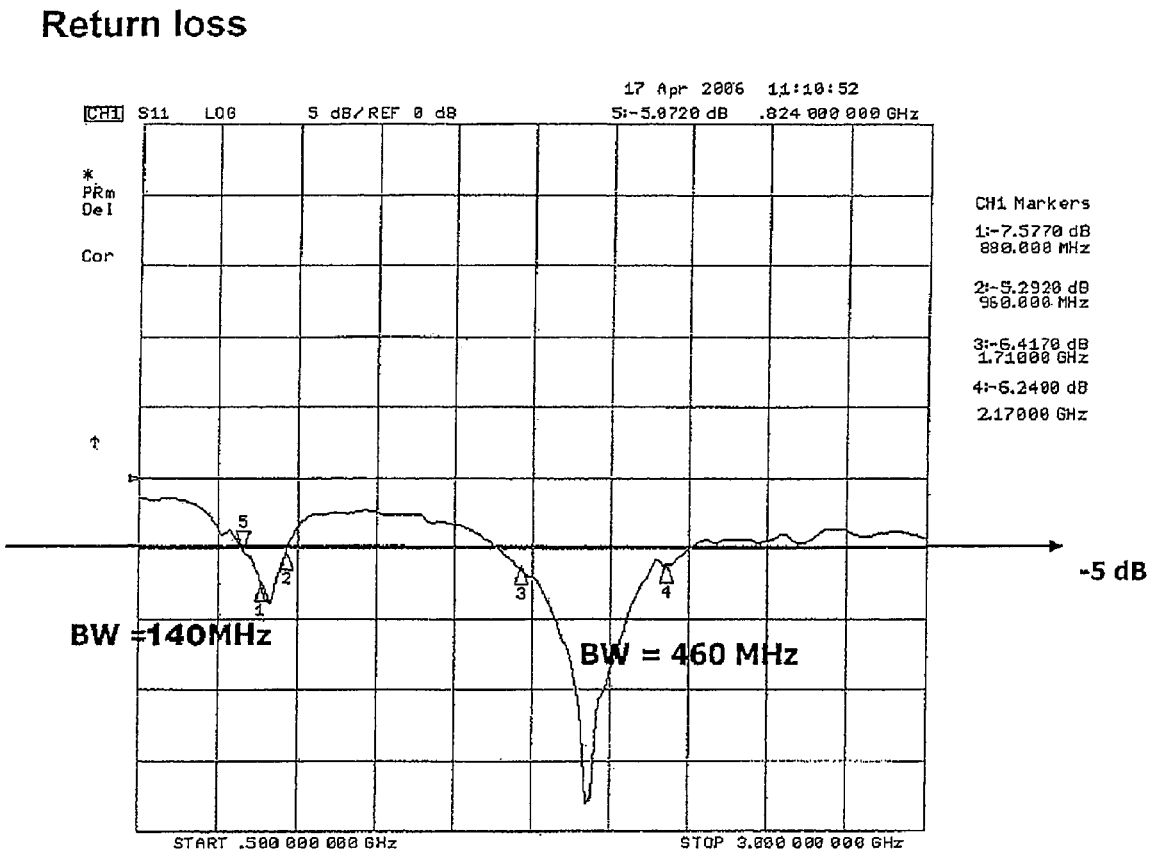
FIG. 4 is a test chart showing a return loss of the multi-frequency antenna shown in FIG. 3.

It can be known from the above data that the present invention has a preferred operation characteristic both at low frequency and high frequency, so as to be compatible with the frequency bands used in AMPS, GSM, DCS, PCS, and UMTS, for example. FIG. 4 is a test chart of a signal return loss of a multi-frequency antenna according to a first embodiment of the present invention. It can be known from FIG. 4 that the antenna can operate in two frequency bands, all requirements on the operational bandwidths of the low and high frequency bands can be satisfied, so the antenna has superior characteristics.

Figure 5:
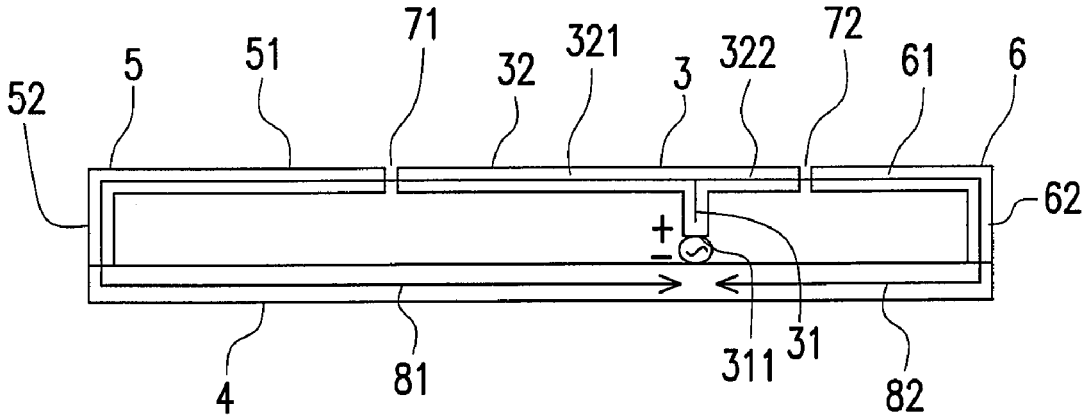
FIG. 5 is an illustration showing operational characteristics of the antenna shown in FIG. 3.

FIG. 5 shows the operational characteristics of the antenna shown in FIG. 3. When an electrical signal is input from the bottom 311 of the first portion 31 of the T-shaped radiator 3, the first portion 31 and the first arm 321 of the T-shaped radiator 3, the longer portion 51, the shorter portion 52, and the ground plane 4 of the first L-shaped radiator 5 forms a longer current path 81. The current path 81 forms a low-frequency loop, such that the antenna produces a low-frequency resonance mode. In the current path 81, a coupling capacitor 71 is used for effectively converting down the frequency and adjusting the impedance matching, and the antenna bandwidth can be broadened through an appropriate distance to achieve an antenna bandwidth of 824-960 MHz, so as to meet the bandwidth usage requirements of the systems such as AMPS and GSM. Meanwhile, the first portion 31 and the second arm 322 of the T-shaped radiator 3, and the longer portion 61, the shorter portion 62, and the ground plane 4 of the second L-shaped radiator 6 also form a shorter current path 82. The current path 82 forms a high-frequency loop, such that the antenna produces a high-frequency resonance mode. The loop path 82 includes a coupling capacitor 72 used for effectively converting down the frequency and adjusting the impedance matching, and the antenna bandwidth can be broadened through an appropriate distance to achieve a bandwidth of 1710-2170 MHz, so as to meet the bandwidth usage requirements of the systems such as DCS, PCS, and UMTS.

Figure 6:
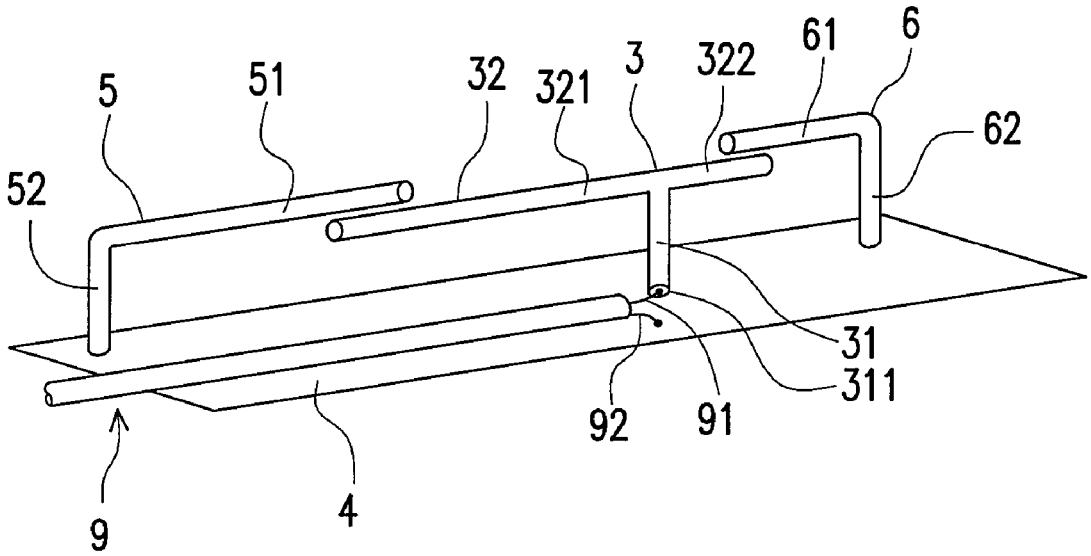
FIG. 6 is a perspective view of an antenna according to a second embodiment of the present invention.

Referring to FIG. 6, the multi-frequency antenna of a second embodiment of the present invention includes a T-shaped radiator 3, a first L-shaped radiator 5 and a second L-shaped radiator 6, a ground plane 4, and a feeder cable 9. The T-shaped radiator 3, the first L-shaped radiator 5, and the second L-shaped radiator 6 are elongated metal element. In this embodiment, a first arm 321 and a second arm 322 of the T-shaped radiator 3 are suspended above the ground plane 4, but the bottom 311 of the first portion 31 of the T-shaped radiator 3 is connected with the positive signal wire 91 of the feeder cable 9 for transmitting an electrical signal to the T-shaped radiator 3, and the negative signal wire 92 of the feeder cable 9 is electrically connected with the ground plane 4.

The two L-shaped radiators include a first L-shaped radiator 5 and a second L-shaped radiator 6 opposite to the first L-shaped radiator 5. The longer portion 51 of the first L-shaped radiator 5 and the longer portion 61 of the second L-shaped radiator 6 point to each other and are spaced away from and parallel to the second portion 32 of the T-shaped radiator 3. In this embodiment, the longer portion 51 of the first L-shaped radiator 5 is parallel to the first arm 321 of the T-shaped radiator 3, and the longer portion 61 of the second L-shaped radiator 6 is parallel to the second arm 322 of the T-shaped radiator 3. The shorter portions 52, 62 are respectively connected with the ground plane 4, thus being grounded. After an electrical signal is input by the positive signal wire 91 of the feeder cable 9 from the bottom 311 of the first portion 31 of the T-shaped radiator 3, a capacitive coupling effect is generated between the first arm 321 of the T-shaped radiator 3 and the longer portion 51 of the first L-shaped radiator 5, thus forming a low-frequency loop. Meanwhile, a capacitive coupling effect is generated between the second arm 322 of the T-shaped radiator 3 and the longer portion 61 of the second L-shaped radiator 6, thus forming a high-frequency loop. Therefore, an operation mode of two frequencies is realized.

Figure 7:
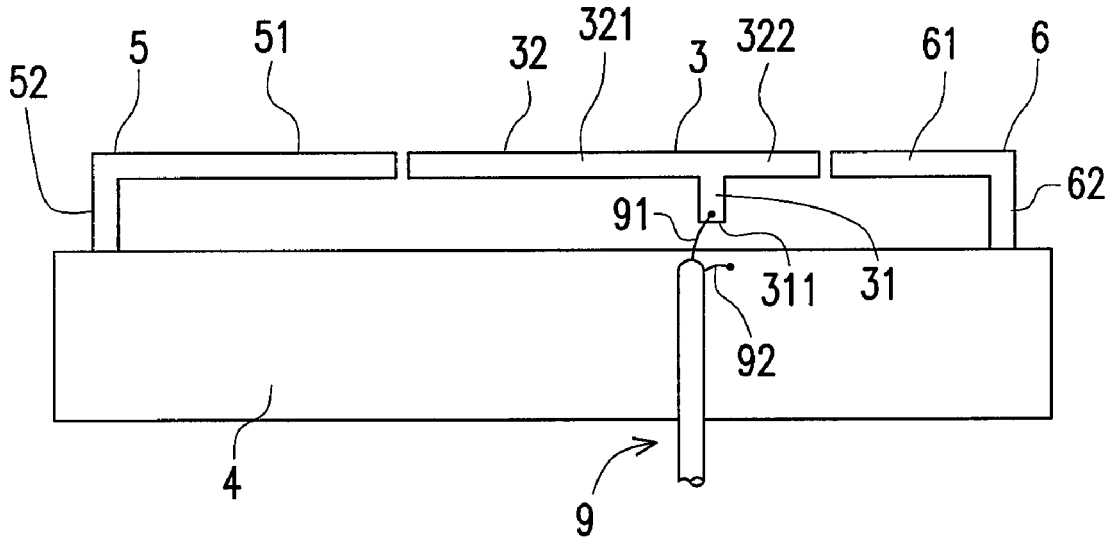
FIG. 7 is a perspective view of an antenna according to a third embodiment of the present invention.

Referring to FIG. 7, the multi-frequency antenna in a third embodiment of the present invention includes a T-shaped radiator 3, a first L-shaped radiator 5 and a second L-shaped radiator 6, a ground plane 4, and a feeder cable 9. The T-shaped radiator 3, the first L-shaped radiator 5, the second L-shaped radiator 6, and the ground plane 4 are all obtained by punching metal sheets. In this embodiment, a first arm 321 and a second arm 322 of the T-shaped radiator 3 are suspended above the ground plane 4, but the bottom 311 of the first portion 31 of the T-shaped radiator 3 is connected with the positive signal wire 91 of the feeder cable 9 for transmitting an electrical signal to the T-shaped radiator 3, and the negative signal wire 92 of the feeder cable 9 is electrically connected with the ground plane 4.

The two L-shaped radiators include a first L-shaped radiator 5 and a second L-shaped radiator 6 opposite to the first L-shaped radiator 5. The longer portion 51 of the first L-shaped radiator 5 and the longer portion 61 of the second L-shaped radiator 6 point to each other and are spaced apart from and parallel to the second portion 32 of the T-shaped radiator 3. In this embodiment, the longer portion 51 of the first L-shaped radiator 5 is parallel to the first arm 321 of the T-shaped radiator 3, and the longer portion 61 of the second L-shaped radiator 6 is parallel to the second arm 322 of the T-shaped radiator 3. The shorter portions 52, 62 are respectively connected with the ground plane 4, thus being grounded. When an electrical signal is input by the positive signal wire 91 of the feeder cable 9 from the bottom 311 of the first portion 31 of the T-shaped radiator 3, a capacitive coupling effect is generated between the first arm 321 of the T-shaped radiator 3 and the longer portion 51 of the first L-shaped radiator 5, thus forming a low-frequency loop. Meanwhile, a capacitive coupling effect is generated between the second arm 322 of the T-shaped radiator 3 and the longer portion 61 of the second L-shaped radiator 6, thus forming a high-frequency loop. Therefore, an operation mode of two frequencies is realized.

Figure 8:
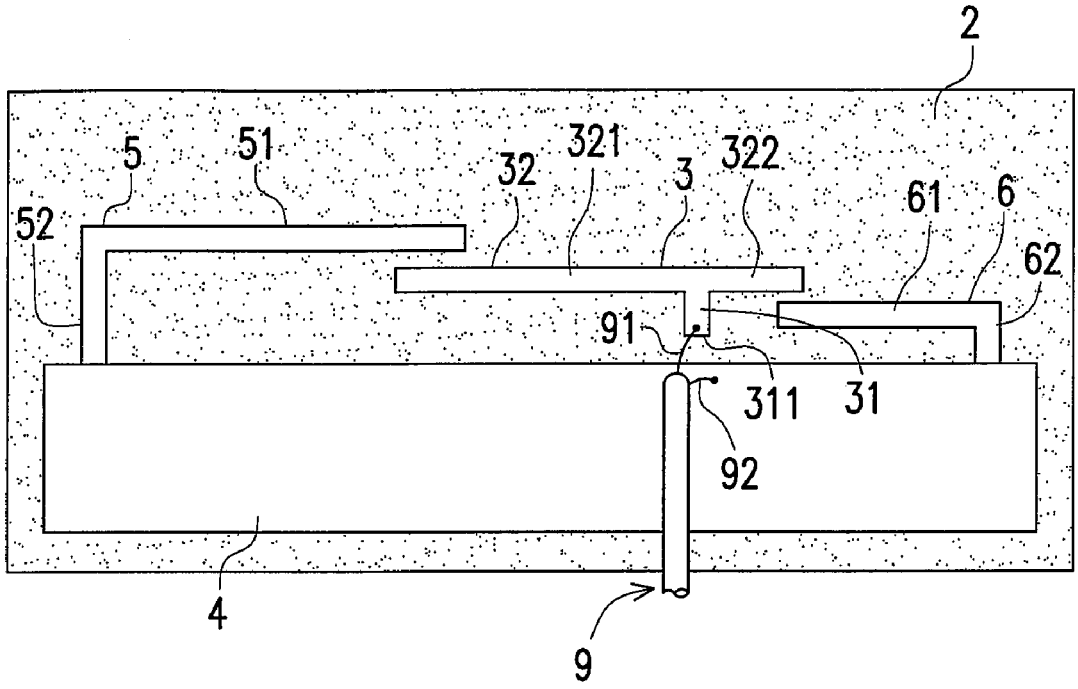
FIG. 8 is a perspective view of an antenna according to a fourth embodiment of the present invention.

Referring to FIG. 8, the multi-frequency antenna of a fourth embodiment of the present invention includes a microwave medium 2, a T-shaped radiator 3, a first L-shaped radiator 5 and a second L-shaped radiator 6, a ground plane 4, and a feeder cable 9. The T-shaped radiator 3, the first L-shaped radiator 5, the second L-shaped radiator 6, and the ground plane 4 are adhered onto the microwave medium 2 by printing or etching. In this embodiment, a first arm 321 and a second arm 322 of the T-shaped radiator 3 are suspended above the ground plane 4, but the bottom 311 of the first portion 31 of the T-shaped radiator 3 is connected with the positive signal wire 91 of the feeder cable 9 for transmitting an electrical signal to the T-shaped radiator 3, and the negative signal wire 92 of the feeder cable 9 is electrically connected with the ground plane 4.

The two L-shaped radiators include a first L-shaped radiator 5 and a second L-shaped radiator 6 opposite to the first L-shaped radiator 5, the portion 51 of the first L-shaped radiator 5 and the portion 61 of the second L-shaped radiator 6 point at each other and are spaced apart from and parallel to the second portion 32 of the T-shaped radiator 3. In this embodiment, the longer portion 51 of the first L-shaped radiator 5 is parallel to the first arm 321 of the T-shaped radiator 3, the longer portion 61 of the second L-shaped radiator 6 is parallel to the second arm 322 of the T-shaped radiator 3, and the shorter portions 52, 62 are respectively connected with the ground plane 4, thus being grounded. When an electrical signal is input by the positive signal wire 91 of the feeder cable 9 from the bottom 311 of the first portion 31 of the T-shaped radiator 3, a capacitive coupling effect is generated between the first arm 321 of the T-shaped radiator 3 and the longer portion 51 of the first L-shaped radiator 5, thus forming a low-frequency loop. Meanwhile, a capacitive coupling effect is generated between the second arm 322 of the T-shaped radiator 3 and the longer portion 61 of the second L-shaped radiator 6, thus forming a high-frequency loop antenna. Therefore an operation mode of two frequencies is realized.

Figure 9:
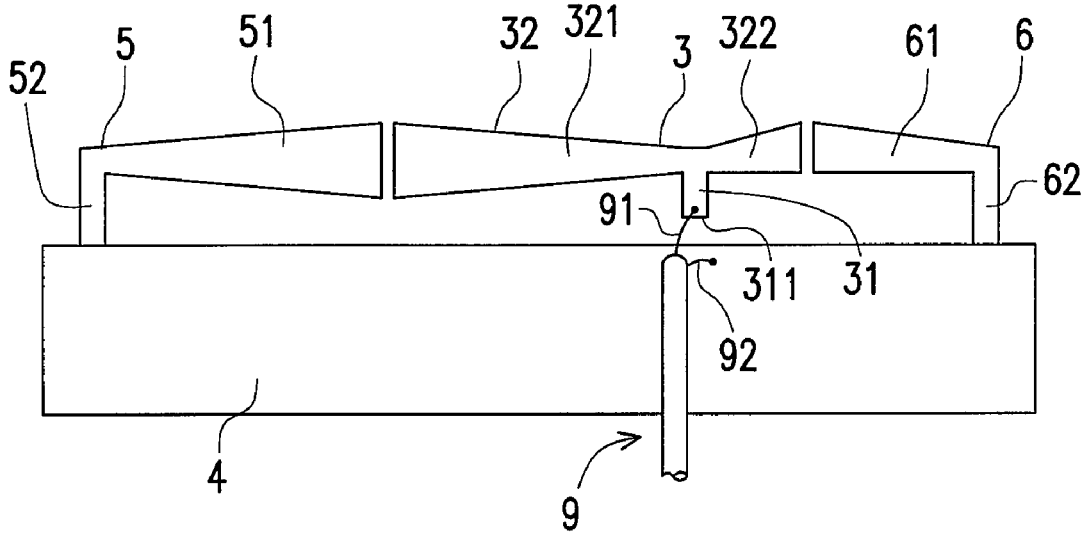
FIG. 9 is a perspective view of an antenna according to a fifth embodiment of the present invention.

Referring to FIG. 9, the antenna of a fifth embodiment of the present invention includes a T-shaped radiator 3, a first L-shaped radiator 5 and a second L-shaped radiator 6, a ground plane 4, and a feeder cable 9. The first arm 321 and the second arm 322 of the T-shaped radiator 3, the longer portion 51 of the first L-shaped radiator 5 and the longer portion 61 of the second L-shaped radiator 6 are trapezoidal metal planes with widened ends. In this embodiment, a first arm 321 and a first arm 322 of the T-shaped radiator 3 are suspended above the ground plane 4, but the bottom 311 of the first portion 31 of the T-shaped radiator 3 is connected with the positive signal wire 91 of the feeder cable 9 for transmitting an electrical signal to the T-shaped radiator 3, and the negative signal wire 92 of the feeder cable 9 is electrically connected with the ground plane 4.

The two L-shaped radiators include a first L-shaped radiator 5 and a second L-shaped radiator 6 opposite to the first L-shaped radiator 5. The longer portion 51 of the first L-shaped radiator 5 and the longer portion 61 of the second L-shaped radiator 6 point to each other and are spaced apart from and parallel to the second portion 32 of the T-shaped radiator 3. In this embodiment, the longer portion 51 of the first L-shaped radiator 5 is parallel to the first arm 321 of the T-shaped radiator 3, and the longer portion 61 of the second L-shaped radiator 6 is parallel to the second arm 322 of the T-shaped radiator 3. The shorter portions 52, 62 are connected with the ground plane 4, thus being grounded. When the electrical signal is input by the positive signal wire 91 of the feeder cable 9 from the bottom 311 of the first portion 31 of the T-shaped radiator 3, the capacitive coupling effect is generated between the first arm 321 of the T-shaped radiator 3 and the longer portion 51 of the first L-shaped radiator 5, thus forming and a low-frequency loop antenna, in which the second arm 321 of the T-shaped radiator 3 and the longer portion 51 of the first L-shaped radiator 5 are trapezoidal metal planes with widened ends, so as to effectively improve the capacitivity of capacitive coupling. Meanwhile, a high-frequency loop is formed by the capacitive coupling effect between the second arm 322 of the T-shaped radiator 3 and the longer portion 61 of the second L-shaped radiator 6, in which the second arm 322 of the T-shaped radiator 3 and the shorter portion 61 of the first L-shaped radiator 5 are trapezoidal metal planes with widened ends, so as to effectively improve the capacitivity of capacitive coupling, such that the two loop antennas form an operation mode of two frequencies.

In the present invention, the structure of the T-shaped radiator 3 and two L-shaped radiators 5, 6 may have other forms, for example a cylindrical shape, in addition to a flat shape as shown in figures, but the present invention is not limited to this. Meanwhile, the flat structure can have other forms, for example a horizontal type, in addition to the vertical type as shown in figures, but the present invention is not limited to this.

In view of the above, the present invention is believed novel and unobvious, and meets the requirements of patent. The embodiments are not given for limiting the scope of the present invention, and people skilled in the art can make some modifications and variations without departing from the spirit and scope of the present invention.

Though the present invention has been disclosed above by the preferred embodiments, they are not intended to limit the present invention. People skilled in the art can make some modifications and variations without departing from the spirit and scope of the present invention.

What is claimed is:

1. An antenna for an electronic device, the antenna comprising:

a ground plane;

a T-shaped radiator having:

a first portion perpendicularly connected to the ground plane; and a second portion further comprising a first arm and a second arm, both perpendicularly connected to the first portion and extending parallel to the ground plane in opposite directions;

a first L-shaped radiator having:

a shorter portion perpendicularly connected to the ground plane with one end thereof, and a longer portion perpendicularly connected to the other end of the shorter portion of the first L-shaped radiator;

a second L-shaped radiator having:

a shorter portion perpendicularly connected to the ground plane with one end thereof; and a longer portion perpendicularly connected to the other end of the shorter portion of the second L-shaped radiator; and a feeder cable having:

a positive signal wire electrically connected with the first portion of the T-shaped radiator; and a negative signal wire electrically connected with the ground plane;

wherein the length of the first arm is different from that of the second arm, the longer portion of the first L-shaped radiator and the second arm of the T-shaped radiator extend in the same direction and the longer portion of the first L-shaped radiator is spaced apart from the first arm of the T-shaped radiator, and the longer portion of the second L-shaped radiator and the first arm of the T-shaped radiator extend in the same direction and the longer portion of the second L-shaped radiator is spaced apart from the second arm of the T-shaped radiator.

2. The antenna as claimed in claim 1, wherein:

the longer portion of the first L-shaped radiator is parallel to the first arm of the T-shaped radiator; and the longer portion of the second L-shaped radiator is parallel to the second arm of the T-shaped radiator.

3. The antenna as claimed in claim 1, wherein the longer portion of the first L-shaped radiator and the longer portion of the second L-shaped radiator are parallel to the second portion of the T-shaped radiator horizontally.

4. The antenna as claimed in claim 1, wherein the longer portion of the first L-shaped radiator and the longer portion of the second L-shaped radiator are parallel to the second portion of the T-shaped radiator longitudinally.

5. The antenna as claimed in claim 1, wherein when an electrical signal is input by the positive signal wire of the feeder cable from the first portion of the T-shaped radiator, a capacitive coupling effect is generated between the first arm of the T-shaped radiator and the longer portion of the first L-shaped radiator, thus forming a low-frequency loop.

6. The antenna as claimed in claim 1, wherein when the electrical signal is input by the positive signal wire of the feeder cable from of the first portion of the T-shaped radiator, a capacitive coupling effect is generated between the second arm of the T-shaped radiator and the longer portion of the second L-shaped radiator, thus forming a high-frequency loop.

7. An antenna for an electronic device, the antenna comprising:

a microwave medium;

a ground plane being adhered onto the microwave medium;

a feeder cable having a positive signal wire and a negative signal wire;

a T-shaped radiator being adhered onto the microwave medium having:

a first portion perpendicularly connected to the ground plane; and a second portion further comprising a first arm and a second arm, both perpendicularly connected to the first portion and extending parallel to the ground plane in opposite directions;

a first L-shaped radiator being adhered onto the microwave medium having:

a shorter portion perpendicularly connected to the ground plane with one end thereof, and a longer portion perpendicularly connected to the other end of the shorter portion of the first L-shaped radiator;

a second L-shaped radiator being adhered onto the microwave medium by printing or etching and having:

a shorter portion perpendicularly connected to the ground plane with one end thereof; and a longer portion perpendicularly connected to the other end of the shorter portion of the second L-shaped radiator; and a feeder cable having:

a positive signal wire electrically connected with the first portion of the T-shaped radiator; and a negative signal wire electrically connected with the ground plane;

wherein the length of the first arm is different from that of the second arm, the longer portion of the first L-shaped radiator and the second arm of the T-shaped radiator extend in the same direction and the longer portion of the first L-shaped radiator is spaced apart from the first arm of the T-shaped radiator, and the longer portion of the second L-shaped radiator and the first arm of the T-shaped radiator extend in the same direction and the longer portion of the second L-shaped radiator is spaced apart from the second arm of the T-shaped radiator.

8. The antenna as claimed in claim 7, wherein:

the longer portion of the first L-shaped radiator is parallel to the first arm of the T-shaped radiator; and the longer portion of the second L-shaped radiator is parallel to the second arm of the T-shaped radiator.

9. The antenna as claimed in claim 7, wherein the longer portion of the first L-shaped radiator and the longer portion of the second L-shaped radiator are parallel to the second portion of the T-shaped radiator horizontally.

10. The antenna as claimed in claim 7, wherein the longer portion of the first L-shaped radiator and the longer portion of the second L-shaped radiator are parallel to the second portion of the T-shaped radiator longitudinally.

11. The antenna as claimed in claim 7, wherein when an electrical signal is input by the positive signal wire of the feeder cable from the first portion of the T-shaped radiator, a capacitive coupling effect is generated between the first arm of the T-shaped radiator and the longer portion of the first L-shaped radiator, thus forming a low-frequency loop.

12. The antenna as claimed in claim 7, wherein when the electrical signal is input by the positive signal wire of the feeder cable from of the first portion of the T-shaped radiator, a capacitive coupling effect is generated between the second arm of the T-shaped radiator and the longer portion of the second L-shaped radiator, thus forming a high-frequency loop.

13. The antenna as claimed in claim 7, wherein the ground plane, the first L-shaped radiator and the second L-shaped radiator are adhered onto the microwave medium by printing or etching.

* * * * *